US005455554A

United States Patent [19]

Sletson et al.

[11] Patent Number: 5,455,554

[45] Date of Patent: Oct. 3, 1995

[54] INSULATING COATING

[75] Inventors: Lisa C. Sletson, Waterford; Robert C. Olen, Oak Creek; Gary A. Gauger, Franklin; Ross S. Daharsh, Milwaukee, all of Wis.; Jeffrey J. Kester, Olean, N.Y.; Sherri J. Cuthbertson, Racine, Wis.

[73] Assignee: Cooper Industries, Inc., Houston, Tex.

[21] Appl. No.: 127,255

[22] Filed: Sep. 27, 1993

[51] Int. Cl.[6] ..... H01C 7/10

[52] U.S. Cl. ..... 338/20; 338/21; 252/519; 264/60

[58] Field of Search ..... 338/20, 21; 252/519; 162/145, 150; 264/60; 148/306; 361/117, 118, 119, 127

[56] References Cited

U.S. PATENT DOCUMENTS

| | | | |
|---|---|---|---|
| 3,857,174 | 12/1974 | May | 29/621 |
| 3,872,582 | 3/1975 | Matsuoka et al. | 29/621 |
| 3,938,069 | 2/1976 | May | 338/21 |
| 3,959,543 | 5/1976 | Ellis | 428/66 |
| 4,031,498 | 6/1977 | Hayashi et al. | 338/21 |
| 4,317,101 | 2/1982 | Ellis et al. | 338/21 |
| 4,450,426 | 5/1984 | Miyoshi et al. | 338/21 |
| 4,460,623 | 7/1984 | Levinson | 338/21 |
| 4,474,718 | 10/1984 | Mattox et al. | 264/61 |
| 4,530,916 | 7/1985 | Matsumoto et al. | 502/209 |
| 4,719,064 | 1/1988 | Nakata et al. | 264/61 |
| 4,855,708 | 8/1989 | Nakata et al. | 338/20 |

*Primary Examiner*—Marvin M. Lateef

*Attorney, Agent, or Firm*—Laff, Whitesel, Conte & Saret, Ltd.

[57] ABSTRACT

A composition for an insulating collar of a metal oxide varistor, with the composition being applied as a slurry to a green varistor in an unfired state along its periphery for enhancing the varistor's energy handling capability in a fired state, the composition having, in various combinations, a plurality of oxide compounds, including manganese dioxide, cobaltic-cobaltous oxide, nickel oxide, tin dioxide, chromic oxide, bismuth oxide, antimony trioxide, and zinc oxide. Moreover, a method of applying the slurry onto the unfired varistor and firing the coated green varistor in a single step.

21 Claims, 5 Drawing Sheets

FIG. 1
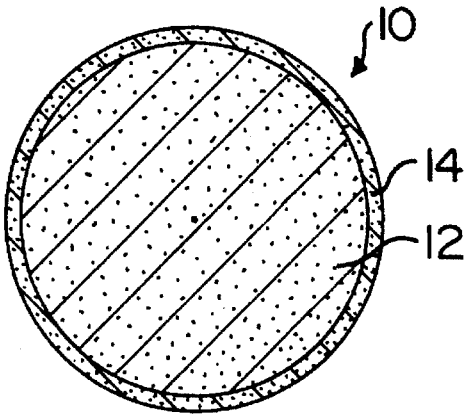
FIG. 2
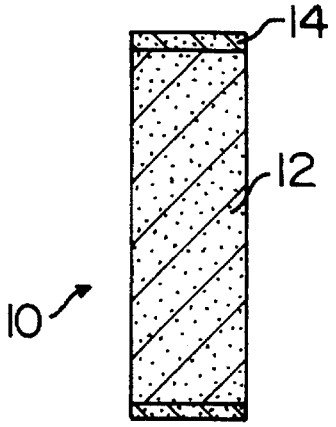
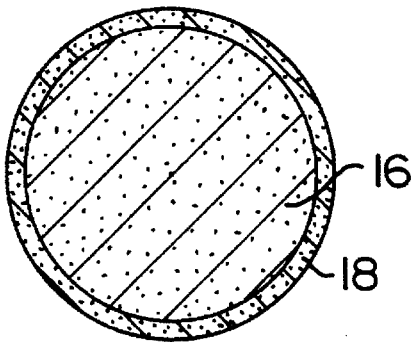
FIG. 3
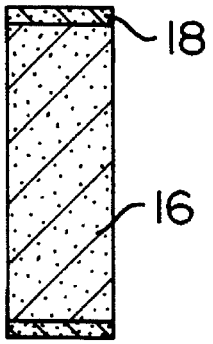
FIG. 4

INSULATING COATING

FIELD OF INVENTION

This invention relates to coated metal oxide varistors and to compositions for coating the varistors. More particularly, this invention relates to the method of preparing the coated metal oxide varistor with an insulating coating of a zinc oxide composition on a varistor with a corresponding zinc oxide composition. In addition, when using this coating, improvements in the energy handling response of the coated varistor have been observed, as well as achieving acceptable nonlinearity and high current, short-duration impulse characteristics.

BACKGROUND OF THE INVENTION

The development of new and improved varistors for use in electrical surge arresters is a continuing concern in view of the ever increasing demand for electricity and electrically powered devices. Varistors are electrical resistors exhibiting a strongly, non-linear relationship between the applied voltage and the resulting current flow. Because of the varistor's non-linear behavior, when a line voltage exceeds the breakdown voltage of this device, the surge is carried away through the varistor and the circuit is thereby protected.

Presently, there exists a variety of varistors, including metal oxide varistors such as zinc oxide varistors and non-metal oxide varistors such as silicon carbide. The metal zinc oxide varistors are ceramics that have highly nonlinear electrical conduction characteristics which make them especially suitable for use as surge arresters or voltage limiters in electrical systems, as opposed to the non-metal oxide varistors which utilize series spark gap devices.

Zinc oxide varistors in surge arresters are subject to low current, long duration impulses, especially when switching conditions prevail in the circuit. The varistors in the arrester must be able to withstand these high energy impulses. Many investigations (U.S. Pat. Nos. 3,760,318; 3,857,174; 3,872,582; 3,903,494; 3,905,006; 3,938,069; 4,031,498; 4,317,101, 4,319,215; 4,326,187; 4,420,737; 4,450,426; 4,460,623; 4,474,718, 4,495,482; 4,692,735; 4,700,169; 4,719,064; 4,724,416; 4,730,179; 4,855,708) in the past have concentrated on improved high current withstand ability, as well as improved varistor stability with respect to high current, short-duration surges and/or operation under steady-state load conditions for long periods of time by coating the varistors with various formulations. It should be kept in mind that the varistors must be coated with an insulating material in order to prevent flashover during these types of electrical conditions on the utility line. U.S. Pat. No. 4,450,426 also addresses an improved low current long duration response for the varistors. However, the coatings in these investigations were applied onto calcined or fully fired devices or with fully non-aqueous based solvent systems. It would be advantageous to arrive at a coating system for application onto an unfired metal oxide component, thereby allowing the coated component to be cofired. It would also be advantageous to develop a carrier system which is aqueous based for the application onto the unfired component thus reducing environmental concerns with the application process. Lastly, once fired, the coated component would provide an improvement in the energy handling response of the resultant metal oxide varistor as well as maintain acceptable nonlinearity and high current, short-duration impulse characteristics for high voltage applications.

SUMMARY OF INVENTION

Accordingly, it is an object of the present invention to provide an aqueous-based vehicle system to allow compositions of appropriate formulations to be applied onto green (unfired) compositions of ZnO-based varistors to allow for the cofiring of the coated green component.

Furthermore, it is an objective of the present invention to provide improved metal oxide varistors having an insulating metal oxide collar coating for use in electrical systems.

A further object of the present invention is to provide a method for preparing improved zinc oxide-based varistors with insulating collars by first coating the green (unfired) component comprised of metal oxides with an aqueous-based ceramic slurry and then cofiring the coated green component.

Another object of the present invention is to provide an insulating coating composition for use with ZnO varistors with a dielectric constant greater than 4 at frequencies between 60 Hz and 10 MHz and temperatures between room temperature and 100° C.

Yet another object of the present invention is to provide an improved metal oxide varistor insulating collar composition that enhances the energy durability while maintaining acceptable nonlinearity and high current, short-duration impulse characteristics for high voltage applications.

The foregoing is achieved by providing a composition comprising in various combinations, a plurality of metal oxide compounds wherein the oxide metals are selected from the group consisting of chrome, tin, manganese, cobalt, zinc, antimony, bismuth and nickel. These oxide compounds can be present in the oxide mixture, in various combinations and are generally in the following ranges based on the total weight of the metal oxide: from about 8% to about 12% by weight selected from the group $MnO_2$, $Co_3O_4$, NiO and mixtures thereof, preferably a mixture containing all three oxides; from about 5% to about 8.5% by weight of metal oxides selected from $Bi_2O_3$ and $SnO_2$ and/or $Cr_2O_3$, with the preferred being a mixture of $SnO_2$, and/or $Cr_2O_3$, with $Bi_2O_3$; from about 27% to about 38% by weight $Sb_2O_3$; and with the remaining proportion (from about 43% to about 58%) of the composition comprised of ZnO.

The preferred ranges are based on the total weight of metal oxides: from about 8% to 10% by weight of metal oxides selected from the group of $MnO_2$, $Co_3O_4$, NiO and mixtures thereof; from about 6% to about 7% by weight of $Bi_2O_3$ and $SnO_2$ and/or $Cr_2O_3$ and the remainder of the composition having a 2:1 or slightly higher ratio of ZnO to $Sb_2O_3$ content. It should be emphasized that other compounds to arrive at oxides of the appropriate metal contents of the above compositions for Mn, Co, Ni, Sn, or Cr would also suffice.

The various above-mentioned oxide coating compositions can be processed into slurries with aqueous or non-aqueous-based systems. The aqueous-based slurry compositions are preferred. Specifically, the preferred carrier is a mixture of water and organic carrier. The water content of the carrier is from about 60% to about 85% by weight of the carrier and is preferably from about 70% to about 85% by weight of the carrier. The organic carrier is selected from ethylene glycol mono alkyl ethers ($R—O—CH_2CH_2—OH$) where $R=C_1–C_6$ alkyl groups and can be in combination with alkyl alcohols ROH where $R=C_2–C_4$. The formulation also contains processing aids such as polyvinyl alcohol (PVA) and a polyelectrolyte for dispersion. Essentially, the proper amounts of the constituents for the coating are weighed out and processed using typical ceramic methods familiar to those skilled in the art resulting in a homogeneous slurry.

The various above-mentioned zinc oxide coating compositions are preferably applied as a slurry to the periphery of the unfired varistor composition, that when co-fired, will result in a coated metal oxide varistor. The slurries may be applied to the green components by brushing, spraying, and/or roll coating. However, those skilled in the art realize that the use of these slurries is not limited by the application technique and how or where they are applied to the components.

The zinc oxide-based formulations we generally use to make the zinc oxide-based varistor, when fired, contain at least 85 weight % zinc oxide. Those skilled in the art will be familiar with formulations leading to devices that portray the electrical properties for zinc oxide varistors, upon firing. The green (unfired) components used were approximately one to about three inches in diameter, and from about 0.5 to about 1.5 inches thick. However, the application of the coating onto the component is not limited to the size or the shape of the components. The ZnO insulating collar coating composition is typically applied to the component with a thickness of from 5 to 20 mils, depending on the particular formulation. Then the coated component is co-fired at temperatures of from about 1100° C. to about 1300° C. for a soak time of from about 0.5 to about 10 hours. Upon firing, these coated components are transformed into metal oxide varistors with an insulating ceramic collar. As a consequence of using our ceramic collar composition and the cofiring step, a varistor is obtained with improved energy durability with respect to low current, long-duration discharge, when compared to varistors coated with a low temperature cure organic resin (applied onto an already-fired disk) while maintaining an adequate nonlinearity and high current, short-duration impulse response. The aforementioned insulating coating composition itself has a dielectric constant greater than 4 at frequencies between 60 Hz and 10 MHz and temperatures between room temperature and 100° C. Moreover, our slurry composition defines an aqueous-based vehicle system that allows a coating of an appropriate formulation to be applied to the green (unfired) component and because of similar firing shrinkage characteristics between these two, the coating adheres well to the component once fired.

BRIEF DESCRIPTION OF THE INVENTION

FIG. 1 is a cross-sectional end view of a coated, unfired zinc oxide based varistor.

FIG. 2 is a cross-sectional side view of the varistor of FIG. 1.

FIG. 3 is a cross-sectional end view of a coated, fired zinc oxide based varistor.

FIG. 4 is a cross-sectional side view of the varistor of FIG.

DETAILED DESCRIPTION OF THE INVENTION

Figure 5:
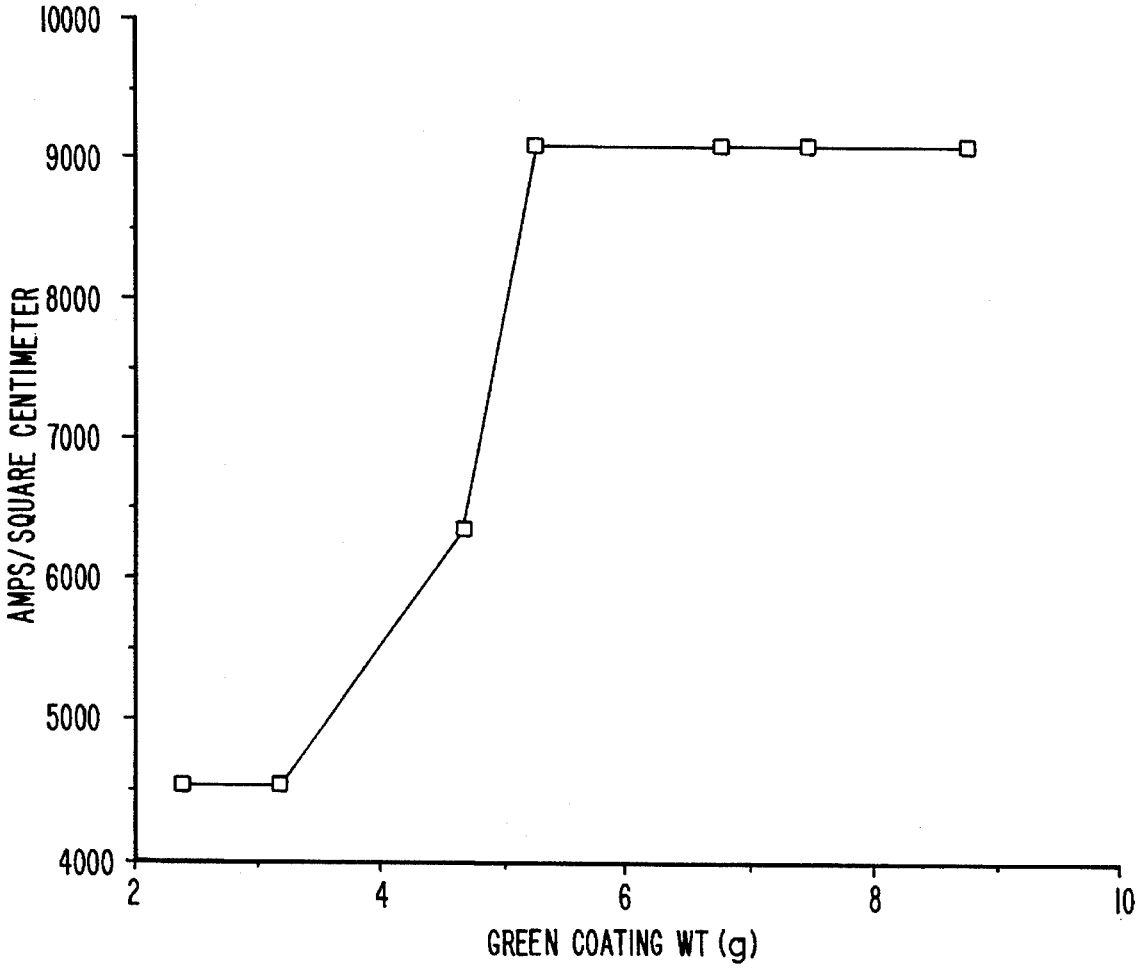
FIG. 5 shows the relationship between green coating thickness and high current, short-duration impulse response.

The present invention contemplates preparing a zinc oxide-based ceramic slurry, applying it to the periphery of an unfired disk composed of metal oxides (with at least one of these being zinc oxide), and firing the slurry-coated disk in a cofiring step to produce an insulative coated metal oxide varistor with improved energy durability, while maintaining acceptable nonlinearity and high current, short-duration impulse characteristics.

The preferred zinc oxide ceramic-based compositions that produce the beneficial results of our invention are, when based on the total weight of metal oxides: from about 8% to 10% by weight of a metal oxide mixture of $MnO_2$, $Co_3O_4$ and NiO; from about 6% to about 7% by weight of a metal oxide mixture of $Bi_2O_3$ and either or both of $SnO_2$ or $Cr_2O_3$; and the remaining portion of the composition having roughly a 2:1 ratio of ZnO to $Sb_2O_3$ content in the formulation. Other compounds substituted for the metal oxides of Mn, Co, Ni, Sn or Cr to arrive at an oxide of the appropriate metal oxide content would also work.

Slurries of the ceramic coating compositions are prepared by loading the metal oxides with the appropriate organic carriers, dispersents, and water into mills for particle size reduction and/or homogeneous mixing of the slurry. The organic carriers will substantially dissipate when the coated green component is fired. Once fired, the coated metal oxide varistor results in an improved energy durability, over metal oxide varistors coated with a low temperature cure organic resin which is applied onto an already-fired disk, while maintaining acceptable nonlinearity and high current, short duration impulse characteristics.

The preferred carrier is a mixture of water and organic carriers. The water content of the carrier is from about 60% to about 85% by weight of the carrier and is preferably from about 70 to about 85% by weight of the carrier. The carrier being a mixture of water, ethylene glycol mono alkyl ether ($C_1$–$C_6$) and alkyl alcohol ($C_2$–$C_4$). Also, the formulation contains processing aids such a polyvinyl alcohol and a polyelectrolyte for dispersion. The two preferred carriers are (a) mixtures of butyl cellosolve, butyl alcohol and water, and (b) butyl carbitol with water. These carrier systems result in high density coatings of reasonable green strength that are substantially free of flaws such as cracking and poor wetting.

The slurry formulations are applied to the periphery of a unfired disk composed of metal oxides. The disk is predominantly made of ZnO, i.e., over about 85% by weight zinc oxide. Application of the slurry to the disk may be made by brushing, spraying, and/or roll coating to provide a coating of from about 5 mil to about 20 mils, depending on the coating formulation. The metal oxide disk and the oxide coating are fired at the same time at temperatures ranging from 1100° C. to about 1300° C. for a soak time of from about 0.5 to about 10 hours. The oxide composition of the coating has a firing shrinkage that is similar to the metal oxide composition of the disk (approximately 20% linear shrinkage on firing) such that on firing the coating adheres well to the disk. Once fired, the coated metal oxide varistor results in an improved energy durability over metal oxide varistors coated with a low temperature cure organic resin (typically dielectric constant—4) which is applied onto an already fired disk while maintaining acceptable nonlinearity and high current, short duration impulse characteristics. The aforementioned insulating coating composition itself has a dielectric constant greater than 4, preferably between 6 and 12, at frequencies between 60 Hz and 10 MHz and temperatures between room temperature and 100° C.

Referring to FIGS. 1 and 2, a coated unfired zinc oxide based metal oxide component (10) includes a metal oxide disk (12) and a zinc oxide ceramic coating (14) that was comprised of one of the preferred slurry composition ranges. After disk (12) and coating (14) have been simultaneously fired, the resultant coated metal oxide varistor (16) (see FIGS. 3 and 4) is prepared for electrical testing by electroding it by any number of well known methods such as thermal spraying. Varistor disk (16) includes coating (18) which is the fired product of unfired coating (14).

The following examples illustrate the inventive slurry compositions and method of applying same to the unfired disks, as well as defining the dielectric properties of an example formulation of the insulating coating itself.

EXAMPLE 1

The following formulation was weighed up and ball milled for approximately 19 hours to allow for sufficient particle size reduction and homogenous mixing of the resultant slurry:

1.08 wt. % $Cr_2O_3$
2.40 wt. % $MnO_2$
2.01 wt. % $Co_3O_4$
4.26 wt. % NiO
5.13 wt. % $Bi_2O_3$
27.64 wt. % $Sb_2O_3$
57.48 wt. % ZnO

The carrier was comprised of 15% by wt. of the non-aqueous carrier, of which 53% by wt. was composed of butyl cellosolve and the remaining of butyl alcohol. The remaining 85% by wt. of the carrier was $H_2O$. Also, processing aids well known to those who work in the ceramics field were used (i.e., PVA and a polyelectrolyte dispersant). The slurry was applied by brushing onto an unfired disk comprised of at least 85 wt. % ZnO that was roughly 2 inches in diameter and 1.5 inches thick. The coating thickness was such to deposit 4 to 5 grams on the disk (≈10 to 15 mils). The coated disks were fired to 1200° C. for 2 hours. The linear firing shrinkage for the coated component was approximately 20%. After firing, the disk faces were lapped flat and electroded for low current, long-duration electrical testing. The first type of electrical test consisted of 20 shots, each shot being approximately 250 A×2000 μs. The test specimens were cooled to room temperature after the 6th, 12th, and 20th shots, respectively. Then disks were subjected to similar shots consecutively until failure. After the initial 20 shots, the sample representing the invention received an additional 11 shots before failure. The sample representing the old technology (organic resin-coated) received 7 additional shots before failure. Another test ran consisted of increasing the current level for the 2000 μs duration until failure. The average highest energy absorption for disks of the invention was 352 J/cc ±31 J/cc (4 samples), while the average for the organic resin-coated samples of the old technology was 261 J/cc±71 J/cc (2 samples). Another advantage of the new technology is that it results in a lower coefficient of variation in the energy data.

EXAMPLE 2

The following formulation was weighed and ball milled for approximately 19 hours to allow for sufficient particle size reduction and homogenous mixing of the resultant slurry:

1.08 wt. % $Cr_2O_3$
2.40 wt. % $MnO_2$
2.01 wt. % $Co_3O_4$
4.26 wt. % NiO
5.13 wt. % $Bi_2O_3$
27.64 wt. % $Sb_2O_3$
57.48 wt. % ZnO

The carrier was comprised of 15% by wt. of butyl carbitol. The remaining 85% by wt. of the carrier was $H_2O$. Also, processing aids well known to those who work in the ceramics field were used (i.e., PVA and a polyelectrolyte dispersant). The slurry was applied by brushing onto an unfired disk comprised of at least 85 wt. % ZnO that was roughly 2 inches in diameter and 1.5 inches thick. The coating thickness was such to deposit 2 to 2.5 grams on the disk (≈5 mils). The coated disks were fired to 1200° C. for 2 hours. The linear firing shrinkage for the coated component was approximately 20%. After firing, the disk faces 29 were lapped flat and electroded for low current, long-duration electrical testing. The first type of electrical test consisted of 20 shots, each shot being approximately 250 A×2000 μs. The test specimens were cooled to room temperature after the 6th, 12th, and 20th shots, respectively. Then disks were subjected to similar shots consecutively until failure. The sample representing the invention received an additional 13 shots, after the initial 20 shots, before failure. The sample representing the old technology (organic resin coated disk) received 7 additional shots before failure. Another test ran consisted of increasing the current level for the 2000 μs duration until failure. The average highest energy absorption for disks of the invention was 364 J/cc±36 J/cc (4 samples), while the average for the organic resin-coated samples of the old technology was 261 J/cc±71 J/cc (2 samples). Again another advantage of the new technology is that it results in a lower coefficient of variation in the energy data.

EXAMPLE 3

The following formulation was weighed and ball milled for approximately 19 hours to allow for sufficient particle size reduction and homogenous mixing of the resultant slurry:

1.08 wt. % $Cr_2O_3$
2.40 wt. % $MnO_2$
2.01 wt. % $CO_3O_4$
4.26 wt. % NiO
5.13 wt. % $Bi_2O_3$
27.64 wt. % $Sb_2O_3$
57.48 wt. % ZnO

The carrier was comprised of 27% by wt. non-aqueous carrier, of which 53% by wt. was composed of butyl cellosolve and the remaining of butyl alcohol. The remaining 73% by wt. of the carrier was $H_2O$. Also, processing aids well known to those who work in the ceramics field were used (i.e., PVA and a polyelectrolyte dispersant). The slurry was applied by brushing onto an unfired disk comprised of at least 85 wt. % ZnO that was roughly 2 inches in diameter and 1.5 inches thick. The coating thickness was such to deposit 4 to 5 grams on the disk (≈10 to 15 mils). The coated disks were fired to 1200° C. for two hours. The linear firing shrinkage for the coated component was approximately 20%. After firing, the disk faces were lapped flat and electroded for low current, long-duration electrical testing.

The first type of electrical test consisted of shots being approximately 250 A×2000 μs on disks that had reduced active element area defined by a smaller than necessary electrode diameter. The test specimens would not receive more than 20 shots, and they were cooled to room temperature after the 6th and 12th shots, respectively. The average number of shots before failure for disks of the invention was 7, whereas the average total number of shots before failure for disks representing the old technology (organic resin-coated disks) was 6. The other test carried out was the 20 shot test described above on samples that did not have a reduced active element area. After this test, the disks were subjected to increasing current levels for the 2000 μs duration until failure. The average highest energy absorption for disks of the invention was 313 J/cc, while the highest energy absorption for the organic resin-coated sample of the old technology was 265 J/cc.

EXAMPLE 4

FIG. 5 shows the relationship between green coating thickness and high current, short duration impulse response for the formulation, application and firing treatment given in Example 3. The response is based on a single shot of a 4×10 μs waveshape. As can be seen, there is correlation between high current impulse withstand and coating thickness. Also, the high current short duration impulse response can be improved (i.e., achieve a second shot at 9091 $A/Cm_2$) by coating the existing insulative coating of the invention with a low temperature cure organic resin material.

EXAMPLE 5—DIELECTRIC RESPONSE OF INSULATING COATING MATERIAL

An oxide formulation composed of that given in examples 1 through 3 was spray dried with a total aqueous-based system containing the necessary organics for processing. A disk of 5.18 cm in diameter by approximately 3.15 cm thick was pressed and fired at 1200° C. for 2 hours. A small sample roughly 0.58 cm in diameter by 0.062 cm thick was cut from this larger sample for dielectric measurements on the insulative formulation itself. This sample was electroded with a silver composition and leaded for the testing.

The capacitances were measured with standard equipment well known to those familiar with varistor characterization.

Figure 6:
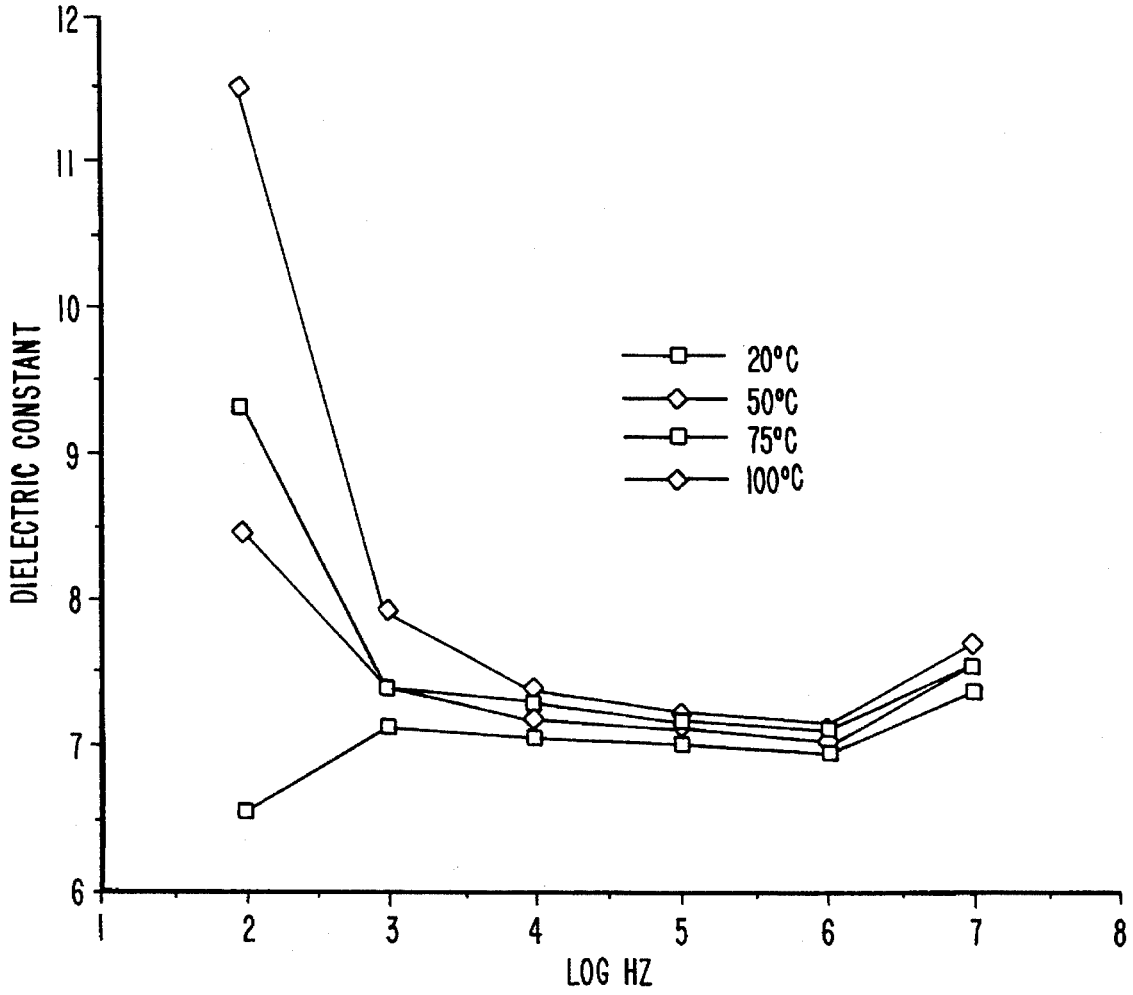
FIG. 6 shows the dielectric constants as a function of frequency.
Figure 7:
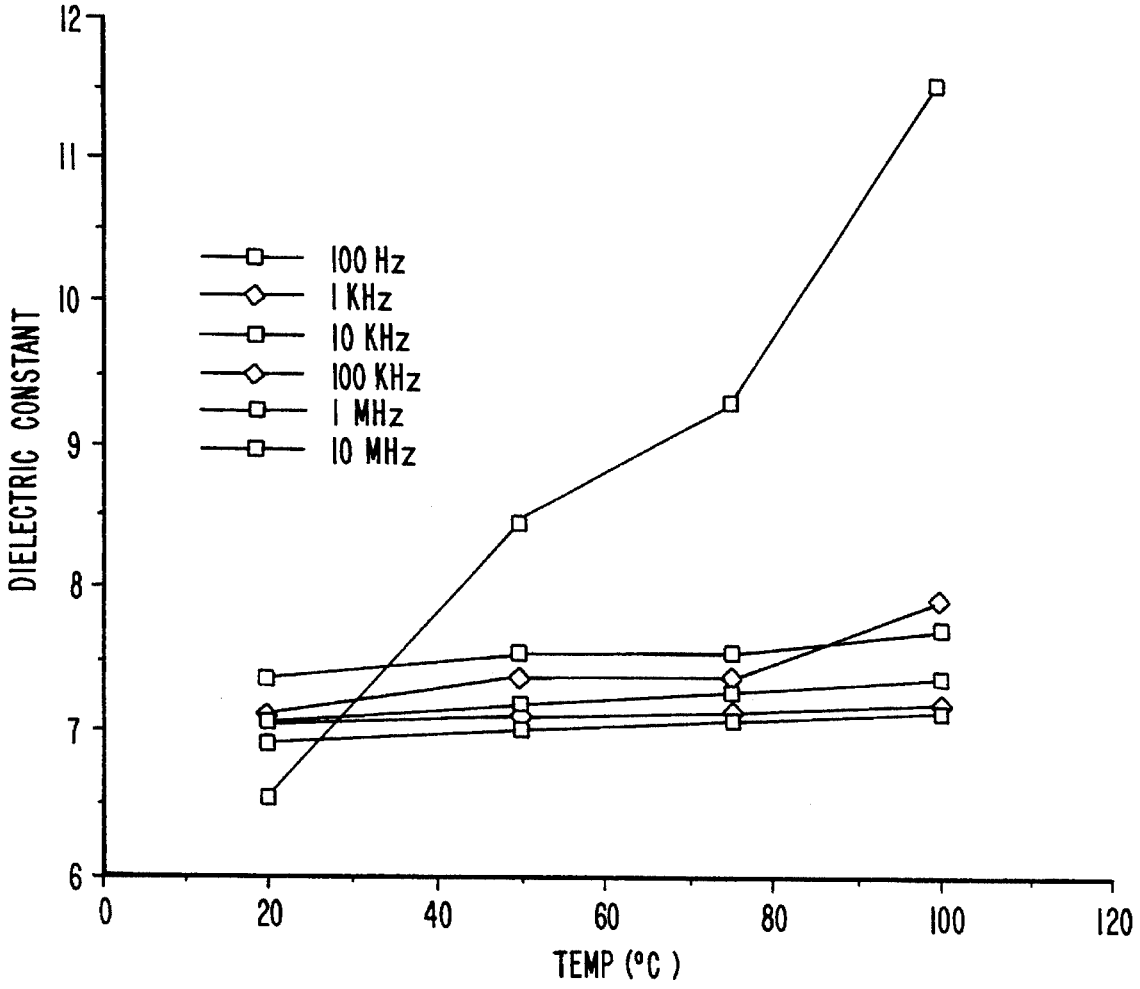
FIG. 7 shows the dielectric constants as a function of temperature.

The dielectric constants as a function of frequency at 20° C., 50° C. 75° C., and 100° C. are given in FIG. 6. The dielectric constant at 60 Hz and 20° C. was calculated to be approximately 6. A decrease in dielectric constant occurred between 100 Hz and 1 kHz for the sample measured at the elevated temperatures. From 1 kHz to 10 MHz, the dielectric constants were relatively stable. For any frequency, the dielectric constants increased with test temperatures, especially at the 100 Hz level. These points are illustrated further in FIG. 7 which shows the dielectric constants as a function of temperature at the various test frequencies.

Figure 8:
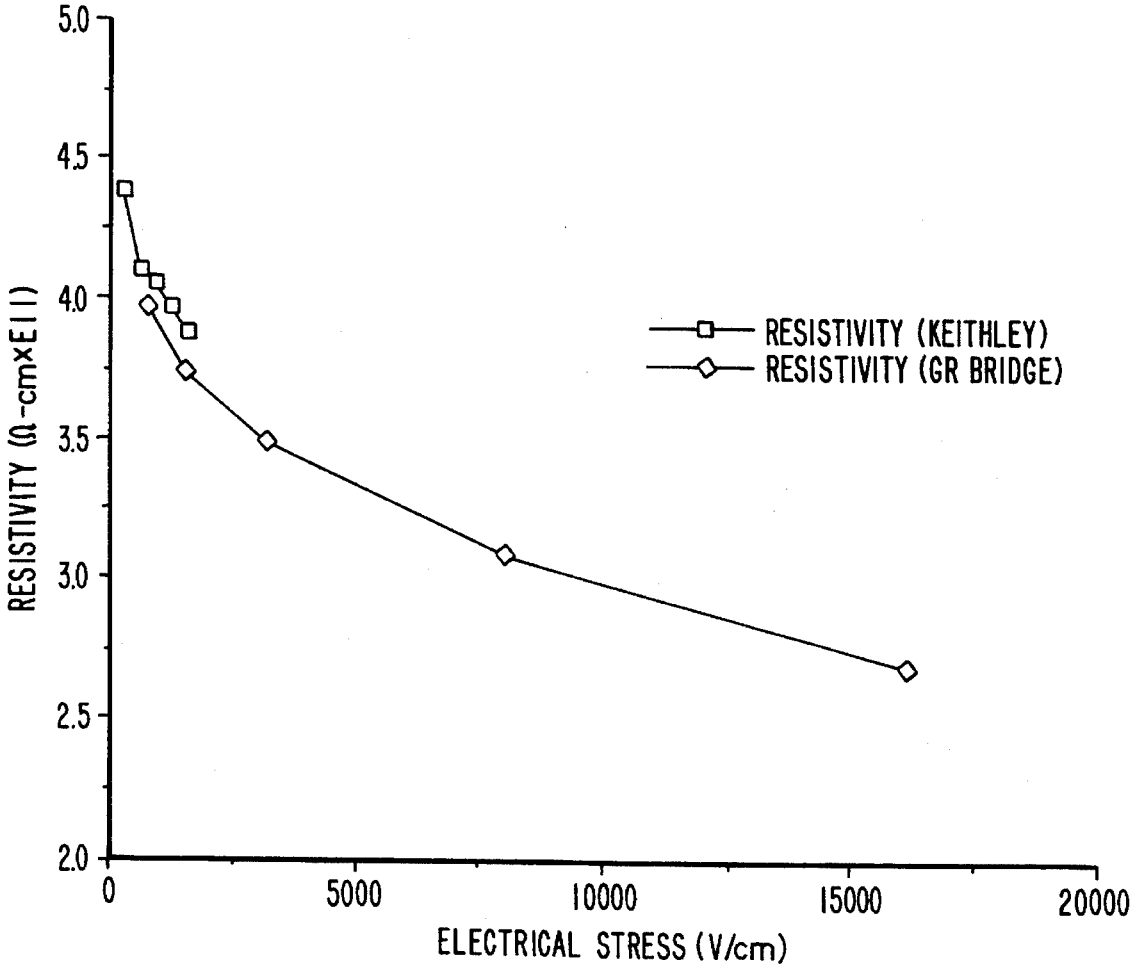
FIG. 8 shows resistivity data as a function of electrical stress.

The resistivity data as a function of electrical stress are given in FIG. 8. The resistivities ranged from $4.4\times10^{11}$ Ω-cm at 323 V/cm to $2.7\times10^{11}$ Ω-cm at 16,129 V/cm.

EXAMPLE 6

The following formulation was weighed up and ball milled for approximately 19 hours to allow for sufficient particle size reduction and homogenous mixing of the resultant slurry:

1.45 wt. % $Cr_2O_3$ 3.22 wt. % $MnO_2$ 2.69 wt. % $Co_3O_4$ 5.71 wt. % NiO 6.87 wt. % $Bi_2O_3$ 37.04 wt. % $Sb_2O_3$ 43.11 wt. % ZnO

The carrier was comprised of 15% by wt. of the non-aqueous carrier, of which 53% by wt. was composed of butyl cellosolve and the remaining of butyl alcohol. The remaining 85% by wt. of the carrier was $H_2O$. Also, processing aids well known to those who work in the ceramics field were used (i.e., PVA and a polyelectrolyte dispersant). The slurry was applied by brushing onto an unfired disk comprised of at least 85 wt. % ZnO that was roughly 2 inches in diameter and 1.5 inches thick. The coating thickness was such to deposit roughly 5 mils on the disk. The coated disks were fired to 1200° C. for 2 hours. The linear firing shrinkage for the coated component was approximately 20%.

It will be appreciated that the above Examples 1–5 illustrate a single-oxide insulating composition and three ceramic slurry compositions and Example 6 illustrates another oxide composition for coating onto a component that, when fired, forms an insulative coated ZnO-based varistor to provide increased energy durability while maintaining acceptable nonlinearity and high current, short-duration impulse characteristics over a varistor coated with a low temperature curc organic resin. Also, the above examples show a method of preparing varistors by coating the green components with the oxide slurry compositions and subjecting them to a co-firing step.

The foregoing is for the purpose of illustration, rather then limitation of the scope of protection accorded this invention. The latter is to be measured by the following claims, which should be interpreted as broadly as the invention permits.

The invention claimed is:

1. A metal oxide varistor insulating collar or coating composition comprising:

a first metal oxide selected from the group consisting of manganese dioxide, cobalt oxide, nickel oxide and a mixture thereof;

an optional second metal oxide selected from the group consisting of tin dioxide, chromic oxide and mixtures thereof;

bismuth oxide;

antimony trioxide; and zinc oxide.

2. A composition for an insulating collar or coating on a metal oxide varistor with said composition containing metal oxides and comprising as a total weight of metal oxides, from about 8% to about 12% of the total weight of the metal oxides is a first metal oxide selected from the group consisting of manganese dioxide, cobalt oxide, nickel oxide and a mixture thereof;

from about 5% to about 8.5% of the total weight of the metal oxides is bismuth oxide and a second metal oxide, said second metal oxide is selected from the group consisting of tin dioxide, chromic oxide and mixtures thereof;

from about 27% to about 38% of the total weight of the metal oxides is antimony trioxide; and from about 43% to about 58% of the total weight of the metal oxides is zinc oxide.

3. The composition of claim 2 wherein the weight ratio of zinc oxide to antimony trioxide is at least 2:1.

4. The composition of claim 3 wherein of the total weight of the metal oxides there is from about 8% to about 10% of the first oxide; and from about 6% to about 7% of bismuth oxide and the second oxide.

5. A composition for an insulating collar or coating on a metal oxide varistor with said composition containing metal oxides and comprising a first oxide which is a mixture of $MnO_2$, $Co_3O_4$ and NiO a second oxide selected from the group consisting of tin dioxide, chromic oxide and mixtures thereof;

bismuth oxide;

antimony trioxide; and zinc oxide.

6. The composition of claim 4 wherein the first oxide is a mixture of $MnO_2$, $Co_3O_4$ and NiO.

7. The composition of claim 2 having:

2.40% by weight of manganese dioxide;

2.01% by weight of cobalt oxide;

4.26% by weight of nickel oxide;

1.08% by weight of chromic oxide;

5.13% by weight of bismuth oxide;

27.64% by weight of antimony trioxide; and 57.48% by weight of zinc oxide.

8. The composition of claim 6 wherein said composition is a slurry with an aqueous or non-aqueous based carrier.

9. The composition of claim 8 wherein said aqueous carrier is a mixture of water and an organic carrier.

10. The composition of claim 8 wherein said carrier includes from about 60% to about 85% by weight of water.

11. The composition of claim 9 wherein said organic carrier is selected from ethylene glycol mono alkyl ethers ($R—O—CH_2CH_2—OH$) where $R=C_1–C_6$ alkyl groups and may be in combination with alkyl alcohols ROH where $R=C_2–C_4$.

12. A varistor containing a central zinc oxide varistor core having at least about 85% by weight of zinc oxide and wherein said varistor has an insulating zinc oxide collar or coating comprising:

a first metal oxide selected from the group consisting of manganese dioxide, cobalt oxide, nickel oxide and a mixture thereof;

an optional second metal oxide selected from the group consisting of tin dioxide, chromic oxide and mixtures thereof;

bismuth oxide;

antimony trioxide; and zinc oxide.

13. The varistor of claim 12 wherein said insulating collar or coating is from about 5 to about 20 mils in thickness.

14. The varistor of claim 13 wherein said insulating collar has a dielectric constant greater than 4 at frequencies between 60 Hz and 10 MHz and temperatures between room temperature and 100° C.

15. A varistor containing a central zinc oxide varistor core having at least about 85% by weight of zinc oxide and wherein said varistor has an insulating metal oxide collar or coating wherein said collar or coating, based on the total weight of metal oxide, comprises:

from about 8% to about 10% by weight of a mixture of manganese dioxide, cobalt oxide, and nickel oxide;

from about 6% to about 7% by weight of chromic oxide or tin oxide and bismuth oxide;

from about 27% to about 29% by weight of antimony trioxide; and from about 54% to about 58% by weight of zinc oxide.

16. A process of producing a varistor having an insulating collar or coating said process comprising the steps of:

preparing a coating composition containing a carrier, said coating composition having a first metal oxide selected from the group consisting of manganese dioxide, cobalt oxide, nickel oxide and mixtures thereof;

a second metal oxide selected from the group consisting of tin dioxide, a chromic oxide or mixture thereof;

bismuth oxide;

antimony oxide; and zinc oxide;

coating a periphery of a green metal oxide varistor with said coating composition to provide a coated green metal oxide varistor; and firing said coated green metal oxide varistor to produce said varistor having said insulating collar or coating.

17. The process of claim 16 wherein said coating composition comprises:

as a total weight of metal oxides, from about 8% to about 12% of the total weight of the metal oxides is selected from the first oxide, from about 5% to about 8.5% of the total weight of the metal oxides is bismuth oxide and the second oxide, from about 27% to about 38% of the total weight of the metal oxides is of antimony trioxide, and from about 43% to about 58% of the total weight of the metal oxides is zinc oxide.

18. The process of claim 16 wherein said coating composition comprises as a total weight of metal oxides:

from about 8% to about 10% by weight of the total weight of the metal oxides is of a mixture of manganese dioxide, cobalt oxide and nickel oxide;

from about 6% to about 7% by weight of the total weight of the metal oxides is of chromic or tin oxide and bismuth oxide;

from about 27% to about 29% by weight of the total weight of the metal oxides is of antimony trioxide; and from about 54% to about 58% by weight of the total weight of the metal oxides is of zinc oxide.

19. The process of claim 16 wherein said carrier contains about 60% to about 85% water.

20. The process of claim 19 wherein the carrier further comprises an organic carrier which is selected from the ethylene glycol mono alkyl ethers ($R—O—CH_2CH_2—OH$) where $R=C_1–C_6$ alkyl groups and can be in combination with alkyl alcohols ROH where $R=C_2–C_4$.

21. The process of claim 18 wherein said varistor and said coating composition are fired at temperatures of from about 1100° C. to about 1300° C. for a soak time of about 0.5 to about 10 hours.

* * * * *

UNITED STATES PATENT AND TRADEMARK OFFICE

CERTIFICATE OF CORRECTION

PATENT NO. : 5,455,554

DATED : October 3, 1995

INVENTOR(S) : Sletson et al.

It is certified that error appears in the above-indentified patent and that said Letters Patent is hereby corrected as shown below:

In the cover page, section [75] Inventors, insert --Rodson Anthony Winston, Niagra Falls, NY--.

Signed and Sealed this

Twentieth Day of August, 1996

Bruce Lehman

*Attest:*

BRUCE LEHMAN

*Attesting Officer*

*Commissioner of Patents and Trademarks*